US007434507B1

(12) United States Patent
Sherwood et al.

(10) Patent No.: US 7,434,507 B1
(45) Date of Patent: Oct. 14, 2008

(54) SYSTEM AND TRASH RECEPTACLE FOR COLLECTING AND COMPACTING TRASH

(75) Inventors: Christopher R. Sherwood, 6412 Manatee Ave. West, Bradenton, FL (US) 34209; Lisa Fitzgerald, Sarasota, FL (US)

(73) Assignee: Christopher R. Sherwood, Bradenton, FL (US)

( * ) Notice: Subject to any disclaimer, the term of this patent is extended or adjusted under 35 U.S.C. 154(b) by 0 days.

(21) Appl. No.: 11/900,338

(22) Filed: Sep. 11, 2007

(51) Int. Cl.
*B30B 1/30* (2006.01)
*B30B 7/00* (2006.01)

(52) U.S. Cl. ..... 100/233; 100/99; 100/215; 100/255; 100/266

(58) Field of Classification Search ..... 100/99, 100/100, 214, 215, 233, 255, 266
See application file for complete search history.

(56) References Cited

U.S. PATENT DOCUMENTS

| | | | | |
|---|---|---|---|---|
| 3,691,967 | A | 9/1972 | Mettetal, Jr. | |
| 3,955,492 | A * | 5/1976 | Topolay | 100/215 |
| 4,152,979 | A * | 5/1979 | Schmidt | 100/344 |
| 4,290,352 | A * | 9/1981 | Schmidt et al. | 100/100 |
| 5,465,914 | A | 11/1995 | Faccia | |
| 5,575,201 | A | 11/1996 | Fenner et al. | |
| 5,842,652 | A | 12/1998 | Warsing et al. | |
| 5,927,626 | A | 7/1999 | Shinjo et al. | |
| 6,158,336 | A * | 12/2000 | Cambiano | 100/345 |
| 6,247,662 | B1 | 7/2001 | Hamilton | |
| 6,505,550 | B2 | 1/2003 | Hamilton | |
| 6,543,343 | B2 | 4/2003 | Taylor | |
| 6,739,535 | B2 | 5/2004 | Labarbera | |
| 6,983,902 | B2 | 1/2006 | Faccia | |
| 7,100,500 | B2 | 9/2006 | Soler | |
| 2004/0031403 | A1 * | 2/2004 | Johnson | 100/901 |
| 2007/0101875 | A1 * | 5/2007 | Poss et al. | 100/229 A |

* cited by examiner

*Primary Examiner*—Jimmy T Nguyen
(74) *Attorney, Agent, or Firm*—Charles J. Prescott

(57) ABSTRACT

A system and trash receptacle for compacting trash within the trash receptacle including a receptacle having upstanding front, side and back panels, a closed bottom, and a lid. The front panel is pivotably movable about a lower pivot axis located at a lower margin thereof by a drivable power unit operably connected between one side panel and front panel. This pivotal movement of the front panel into the interior volume of the receptacle compacts the trash within the receptacle to minimize the frequency of receptacle emptying required. A vehicle includes a power output which is temporarily engagable with the power unit as the vehicle is driven up to the trash receptacle, the power output driving the power unit to close the front panel to compact the trash within the receptacle.

18 Claims, 16 Drawing Sheets

SYSTEM AND TRASH RECEPTACLE FOR COLLECTING AND COMPACTING TRASH

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This disclosure relates generally to vehicles and systems for collecting and removing trash in commercial and residential community settings and more particularly to a system and trash receptacle for intermittently compacting trash deposited within the trash receptacle to reduce the frequency of trash receptacle emptying required.

2. Description of Related Art

In commercial and residential community settings, large receptacles or bins are provided at strategic locations for individual depositing of trash into one or more trash receptacles. One or more lids are typically pivotally openable for trash to be deposited into the receptacle and periodically, a large waste collection vehicle is scheduled to visit each of the trash receptacles and by interengagement with large forwardly extending forks, temporary engagement with each trash receptacle to lift it and invert it over the open top of the truck cargo bed of the vehicle to empty trash from the trash receptacle and then to replace it on the ground for continued use.

The trash pick up service for this routine scheduled emptying of the trash receptacles constitutes a significant expenditure for the commercial establishment or residential community and is typically billed on a per-visit basis. However, many times these trash receptacles are less than full and the emptying schedule is excessive in that the trash receptacles could easily be filled with additional trash before emptying occurs.

Moreover, trash which is typically loosely thrown into these trash receptacles accelerates the appearance of trash receptacle fullness whereas, if somehow compacted or otherwise reduced in overall volume, the trash receptacle could easily handle significantly increased amounts of compacted trash before the receptacle would be required to be emptied.

A number of prior art vehicles, systems and receptacles are known in prior art which attempt to address this issue of increasing the efficiency and cost of trash removal as follows:

U.S. Pat. No. 3,691,967 to Mettetal, Jr. discloses a mobile apparatus for compacting refused. It is the primary object of the '967 patent to provide a mobile refuse compacting vehicle for compacting refused contained in separately located receptacles which will extend the time interval between the unloading of such receptacles. LaBarbera teaches a mobile trash pulverizer in U.S. Pat. No. 6,739,535. As is shown in FIG. 1, the self-propelled vehicle pulls up to an open top container and, using a pivoting arm with a heavy pulverizing roller, compacts the trash contained therein.

A device for compacting waste in containers is disclosed in newly-issued U.S. Pat. No. 7,100,500 to Soler as shown in FIG. 3. The Soler device teaches a vehicle having a platform, handling arm, compactor roller and support frame. A transportable recyclable materials densifier is disclosed in U.S. Pat. No. 6,543,343 to Taylor. The system of the '343 patent uses an integral conveyor, separator and compacting chamber.

Shinjo, et al. teach a solid substance crushing vehicle which is able to move to a collection center in U.S. Pat. No. 5,927,626 and a waste recycling processing vehicle is described in U.S. Pat. No. 5,842,652 to Warsing, et al.

A compactor comprising a rotating auger for breaking waste material is disclosed in U.S. Pat. No. 5,575,201 to Fenner, et al. and Faccia teaches a combined shredding and mixing truck in U.S. Pat. Nos. 5,465,914 and 6,983,902.

Waste compaction apparatus with a screw conveyor for waste material compacting is taught by Hamilton in U.S. Pat. No. 6,247,662 and the method and apparatus is disclosed in U.S. Pat. No. 6,505.550. The front page of a refuse collecting and disposal handling vehicle teaching two vehicles working in tandem is taught by Talamantez in U.S. Pat. No. 6,305,625.

The present disclosure teaches a unique system and trash receptacle as a separate service offering for compacting trash deposited within the trash receptacle periodically in between times of trash removal by a commercial trash collection operation. A compaction vehicle periodically visits each trash receptacle in the system to operate a power unit which effects compaction of the trash collected within the trash receptacle and, at a point when the operator of the compaction vehicle determines that the compacted trash has adequately filled the receptacle, a radio signal is activated to advise the waste collection company that the trash receptacle is ready for emptying.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This disclosure is directed to a system for compacting trash within a trash receptacle including a trash receptacle having upstanding front, side and back panels, a closed bottom, and a lid. The front panel is pivotably movable about a lower pivot axis located at a lower margin thereof by a drivable power unit operably connected between one side panel and a front panel. This pivotal movement of the front panel into the interior volume of the trash receptacle compacts the trash within the receptacle to minimize the frequency of receptacle emptying required. A mobile vehicle includes a power output which is temporarily engagable with the power unit as the vehicle is driven up to the trash receptacle, the power output driving the power unit to close the front panel to compact the trash within the receptacle.

It is therefore an object of this disclosure to provide a system for compacting trash within a trash receptacle of the system at least once in between scheduled periods of emptying of the trash receptacle.

Yet another object of this invention is to provide a means for compacting loose trash deposited within a uniquely configured trash receptacle to reduce the cost and frequency of emptying of the trash receptacle by use of a commercial trash collection vehicle.

Yet another object of this invention is to provide a trash receptacle which is adapted for compacting loose trash deposited therewithin by a compaction vehicle equipped with a power output for temporary engagement with a power unit of the trash receptacle to effect compaction of the loose trash collected within the trash receptacle.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference of the drawings and by study of the following descriptions.

BRIEF DESCRIPTION OF THE SEVERAL VIEWS OF THE DRAWING(S)

Figure 1:
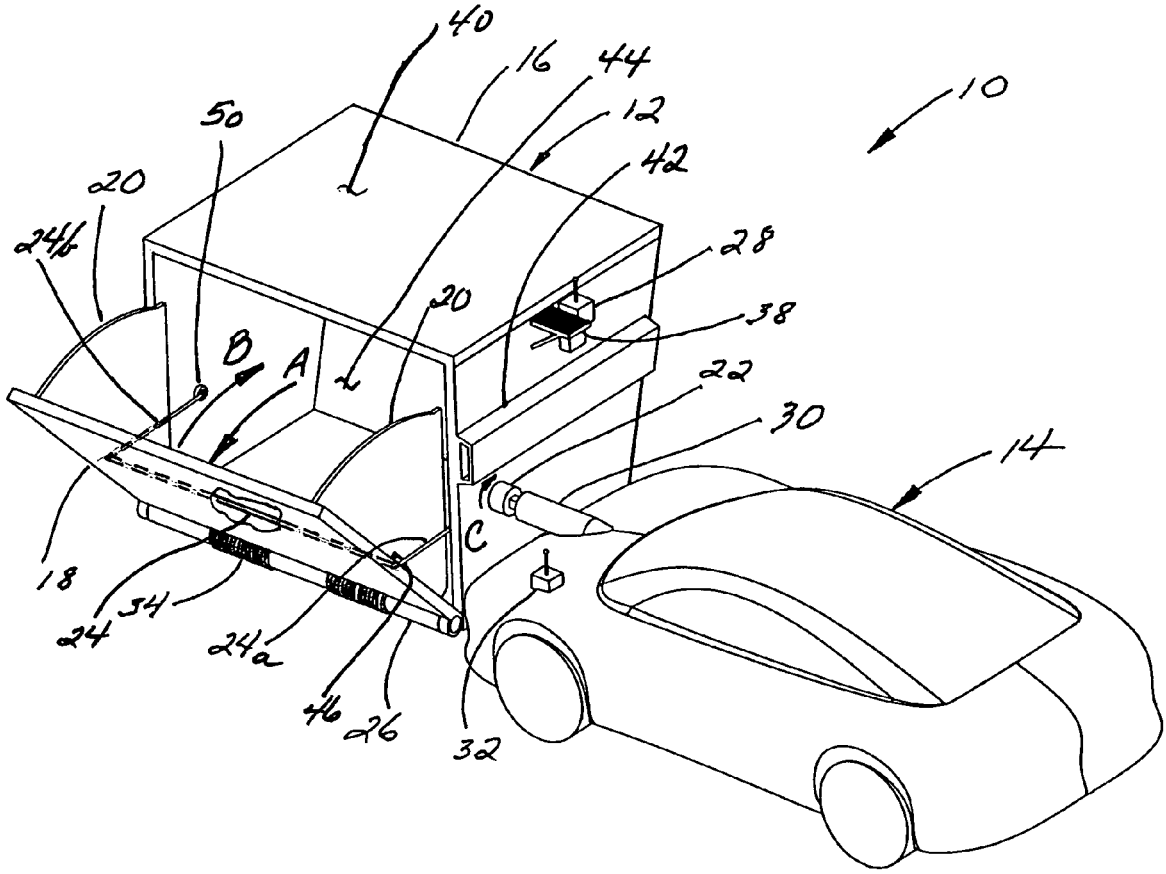
FIG. 1 is a perspective view of one embodiment of the system showing the trash receptacle in an open position temporarily interengaged with a compaction vehicle as one aspect of this embodiment.
Figure 2:
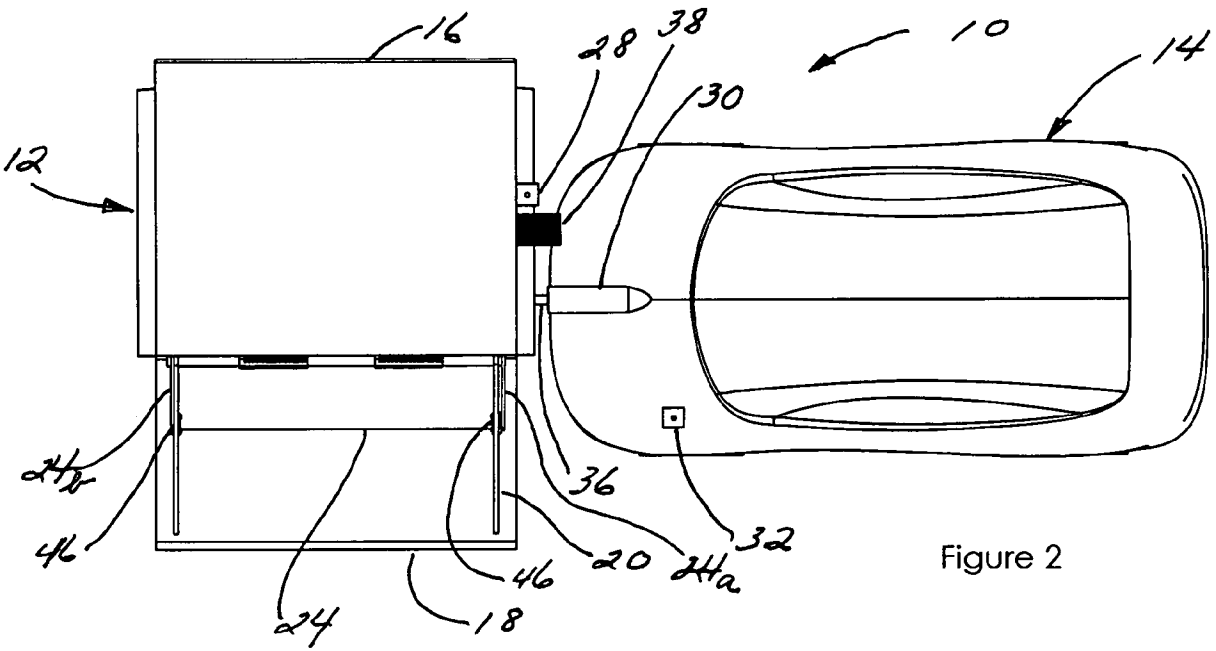
FIG. 2 is a top plan view of FIG. 1.
Figure 3:
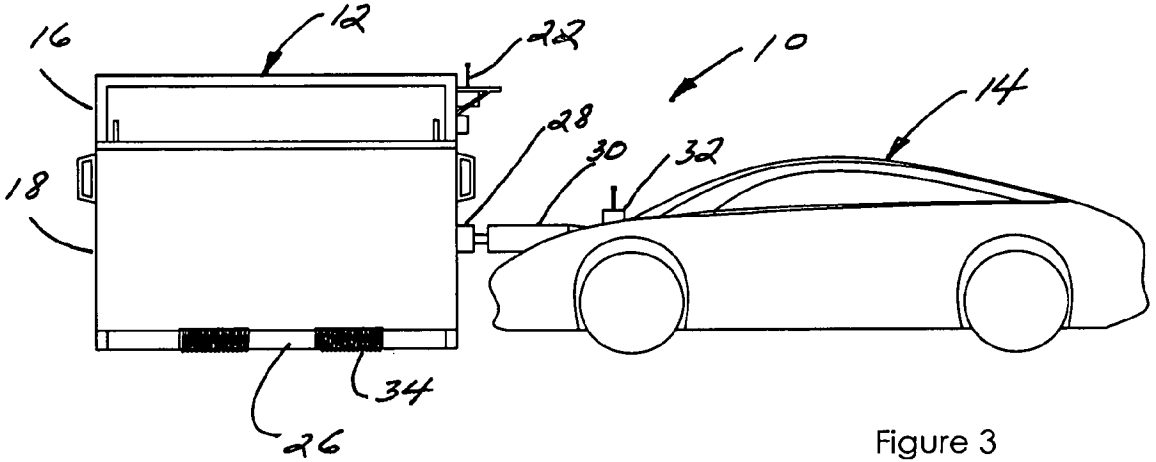
FIG. 3 is a front elevation view of FIG. 1.
Figure 4:
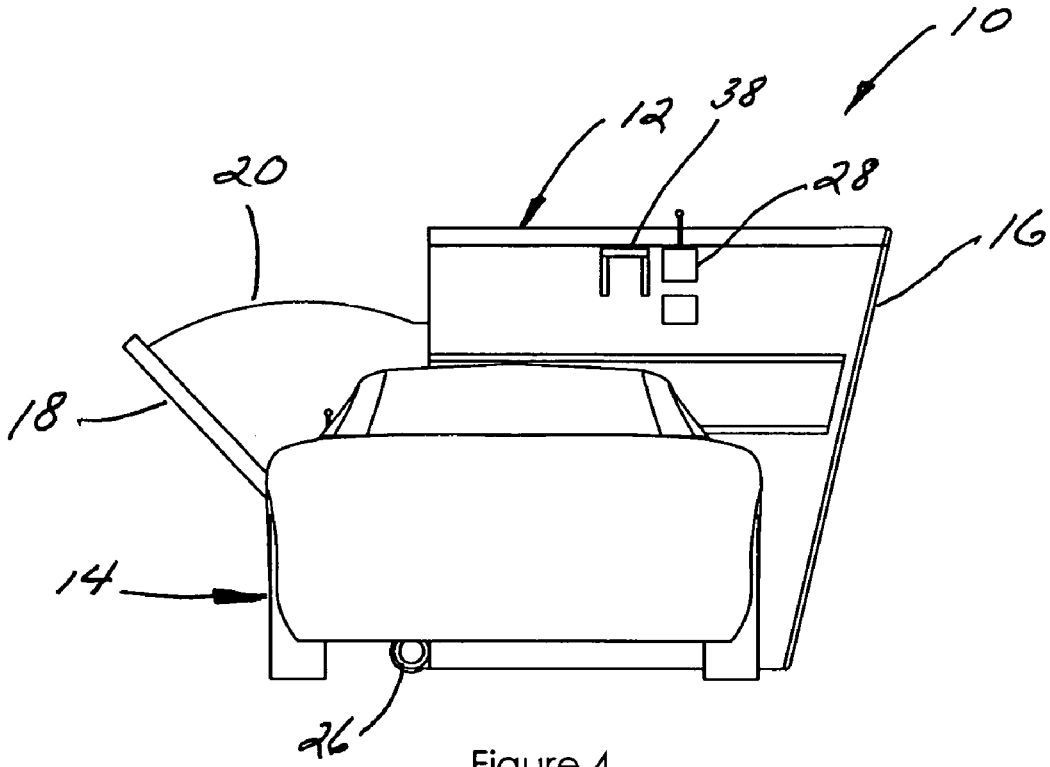
FIG. 4 is a side elevation view of FIG. 1.
Figure 5:
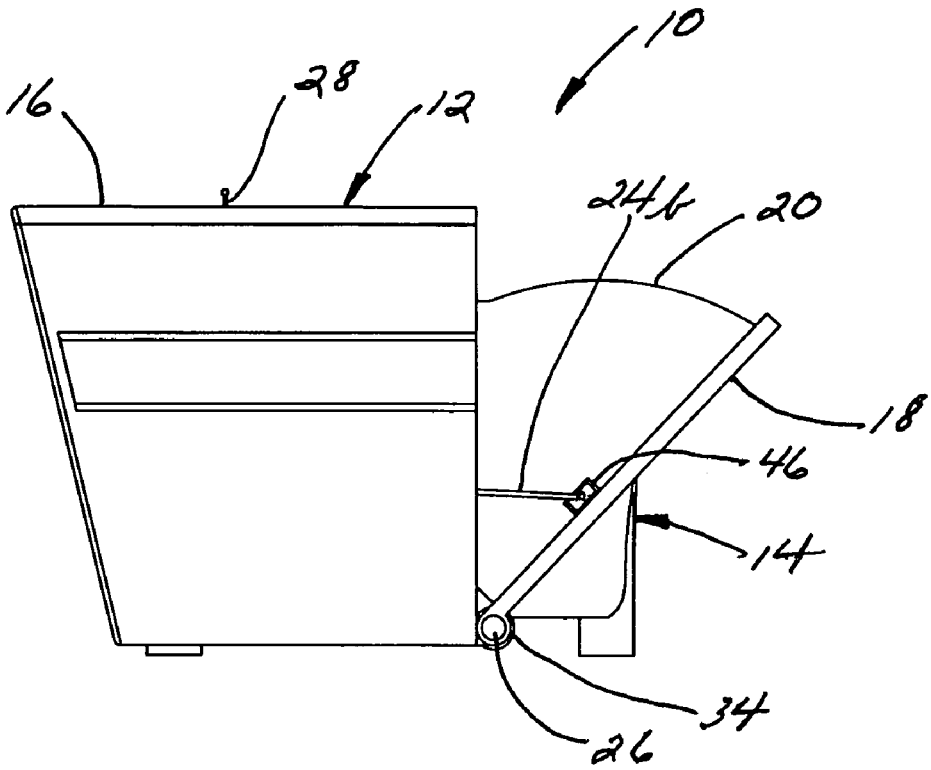
FIG. 5 is another side elevation view of FIG. 1 in the opposite direction from that shown in FIG. 4.
Figure 6:
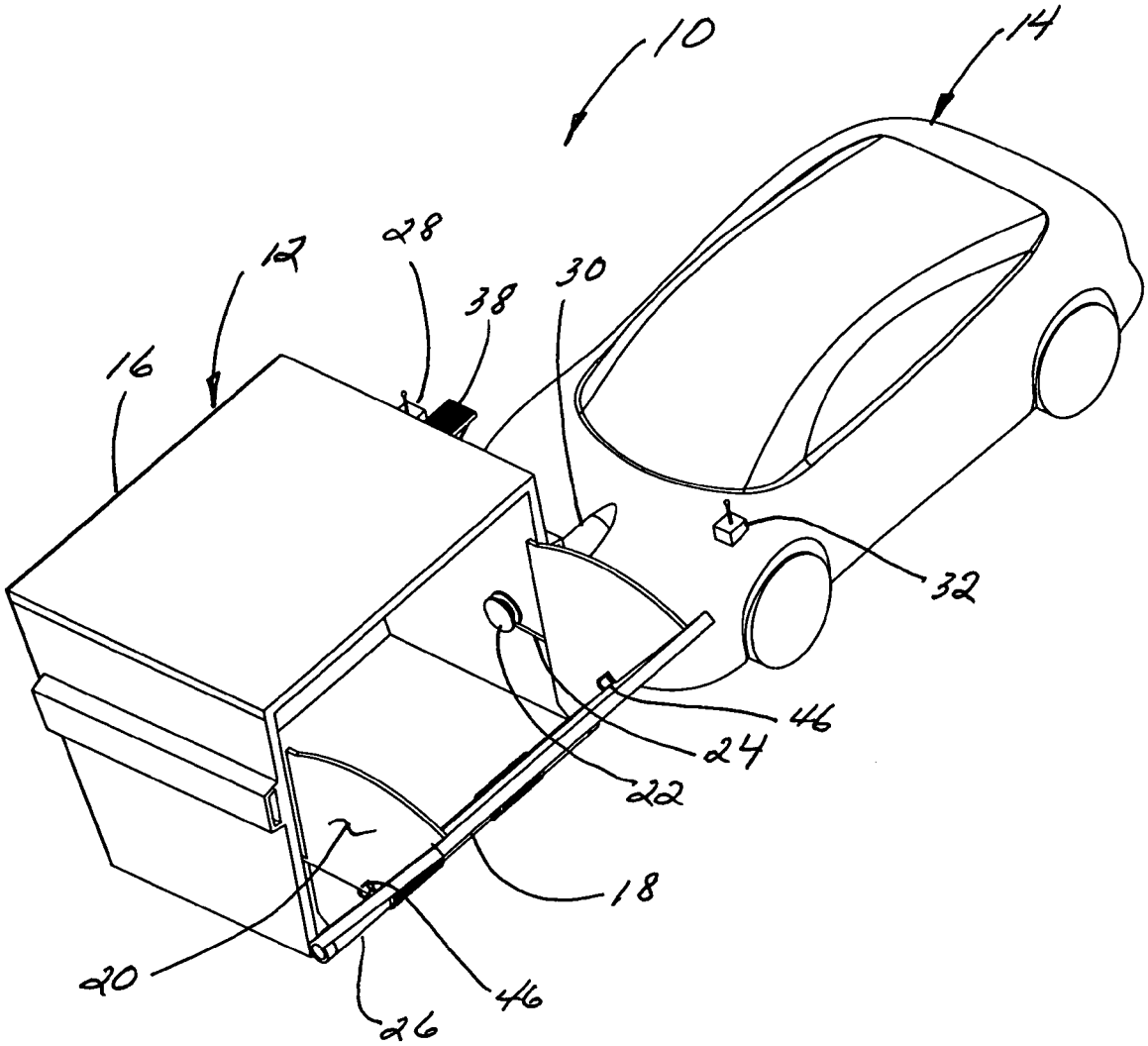
FIG. 6 is another perspective view of FIG. 1.

Exemplary embodiments are illustrated in reference figures of the drawings. It is intended that the embodiments and figures disclosed herein are to be considered to illustrative rather than limiting.

DETAILED DESCRIPTION OF THE INVENTION

Referring now to the drawings, the system of this disclosure in its preferred embodiment is shown generally at numeral 10 in the various figures. This system generally includes a uniquely configured trash receptacle 12 and a compaction vehicle 14. The trash receptacle 12 includes a receptacle 16 having upstanding side panels, a back panel, a bottom, an openable lid 40 hingedly attached to the upright back panel for emptying of the contents of the trash receptacle 12 as will be described herebelow.

A front panel 18 forming the front of the receptacle 16 is pivotally connected by an elongated hinge 26 disposed along the horizontal lower margin of the front panel 18 and is biased toward the open position by coil springs 34 positioned around the hinge 26. End panels 20 are connected along the upright of the end margins of the front panel 18 and extend orthogonally inwardly from the front panel 18 into the interior volume 44 of the receptacle 16 and serve to prevent trash within the receptacle 16 from inadvertently falling out onto the ground when the front panel 18 is in the open position.

Figure 21:
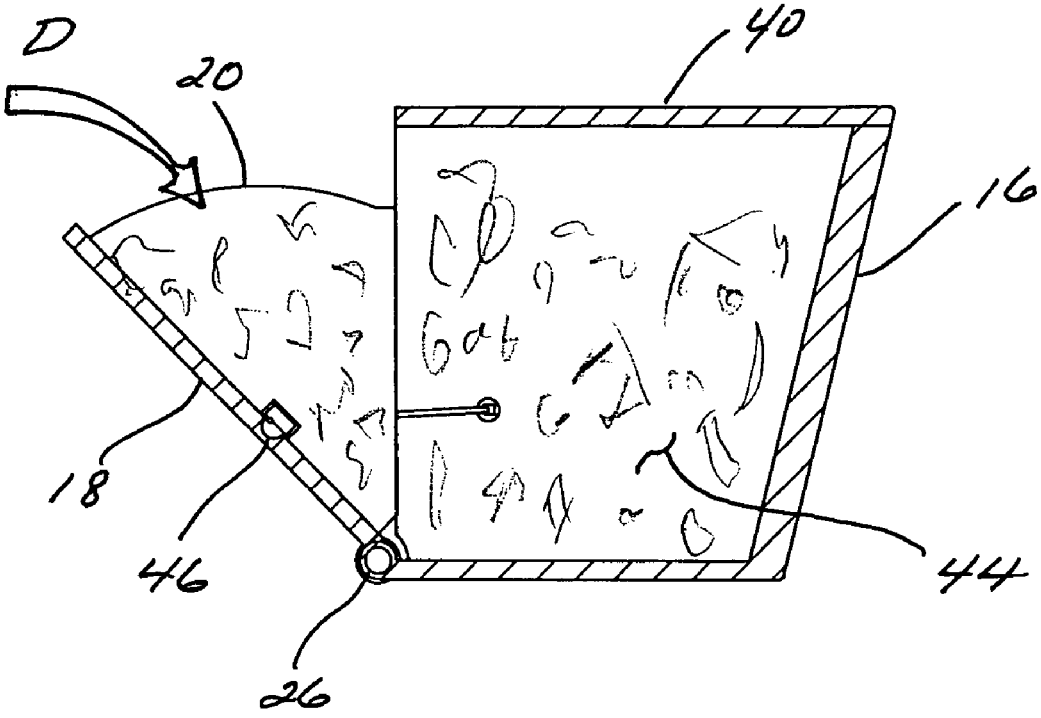
FIG. 21 is a section view through arrows 21-21 of FIG. 20.
Figure 22:
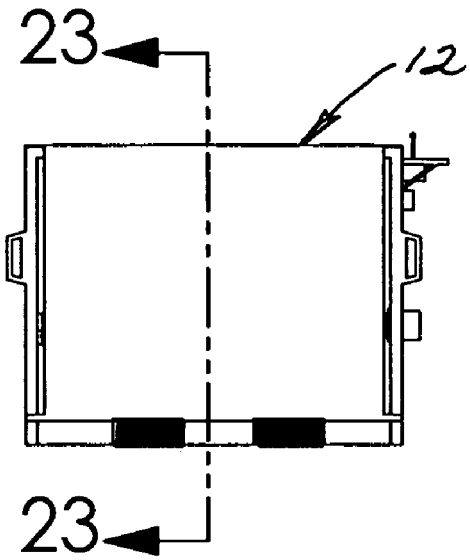
FIG. 22 is a reduced size front elevation view of the trash receptacle of FIG. 1 as shown in FIG. 15.

The trash receptacle 12, when in the open configuration as shown in FIGS. 1 to 6, 10 to 14, and 20 to 21, is ready to receive loose trash and other such disposable items into the interior volume of the trash receptacle 12 in the direction of arrow D in FIG. 21 through the opening formed when the front panel 18 is opened by biasing springs 34 in the direction of arrow A as seen in FIG. 1.

Figure 13:
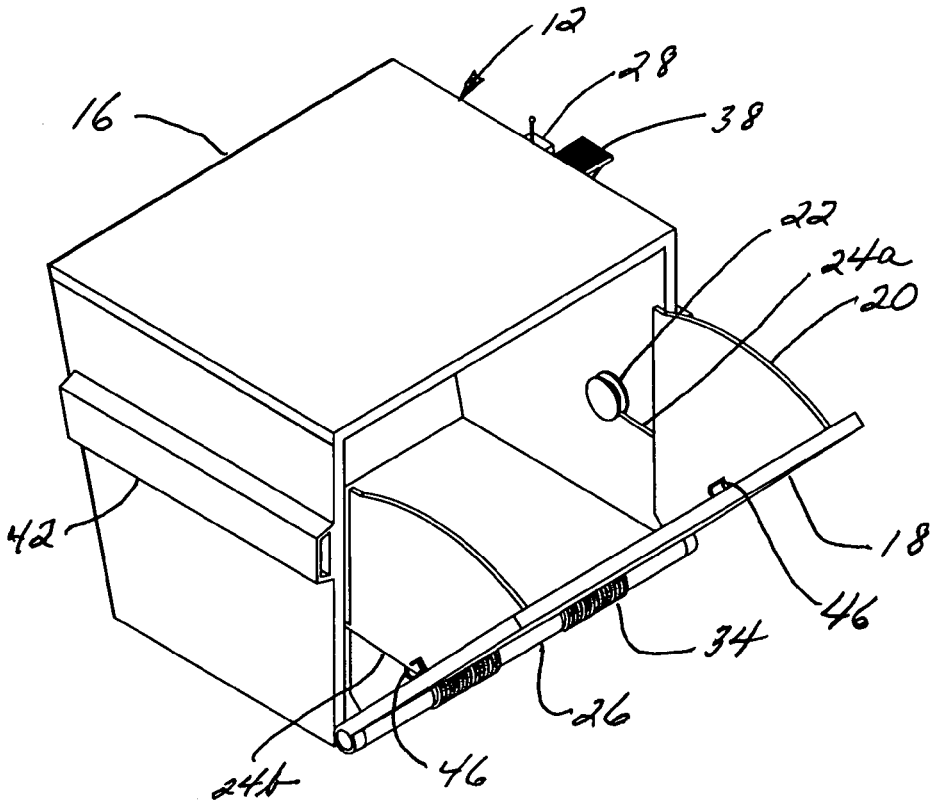
FIGS. 13 and 14 are perspective views of FIG. 10.
Figure 14:
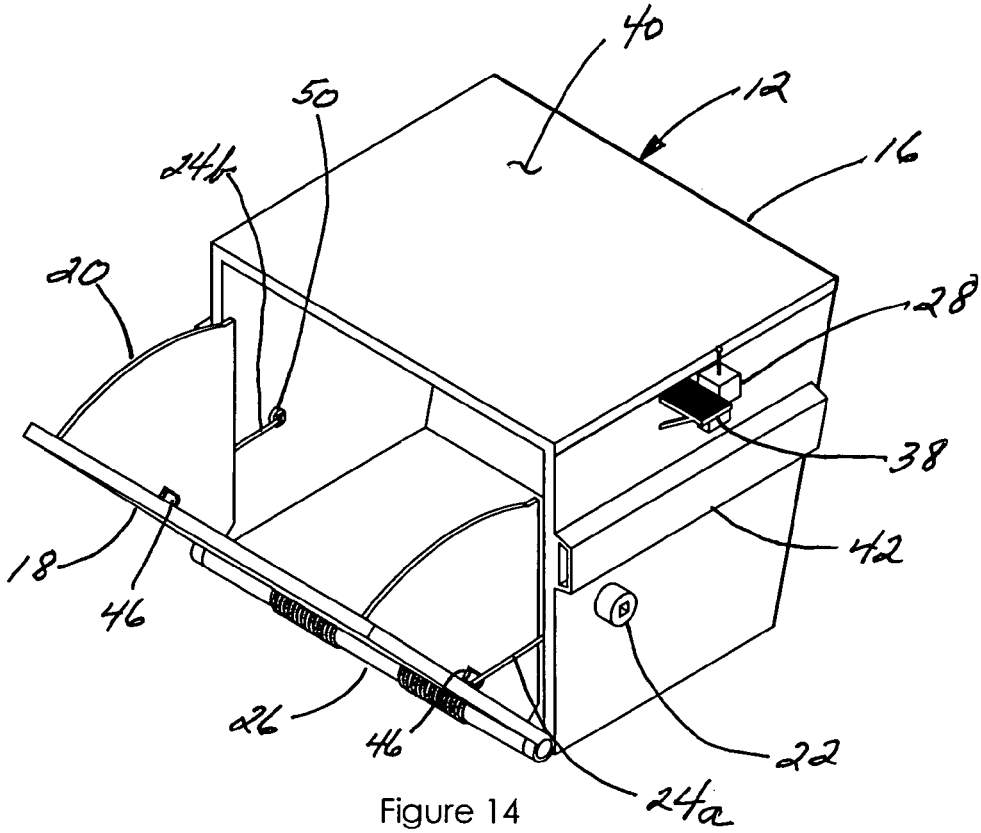
Figure 15:
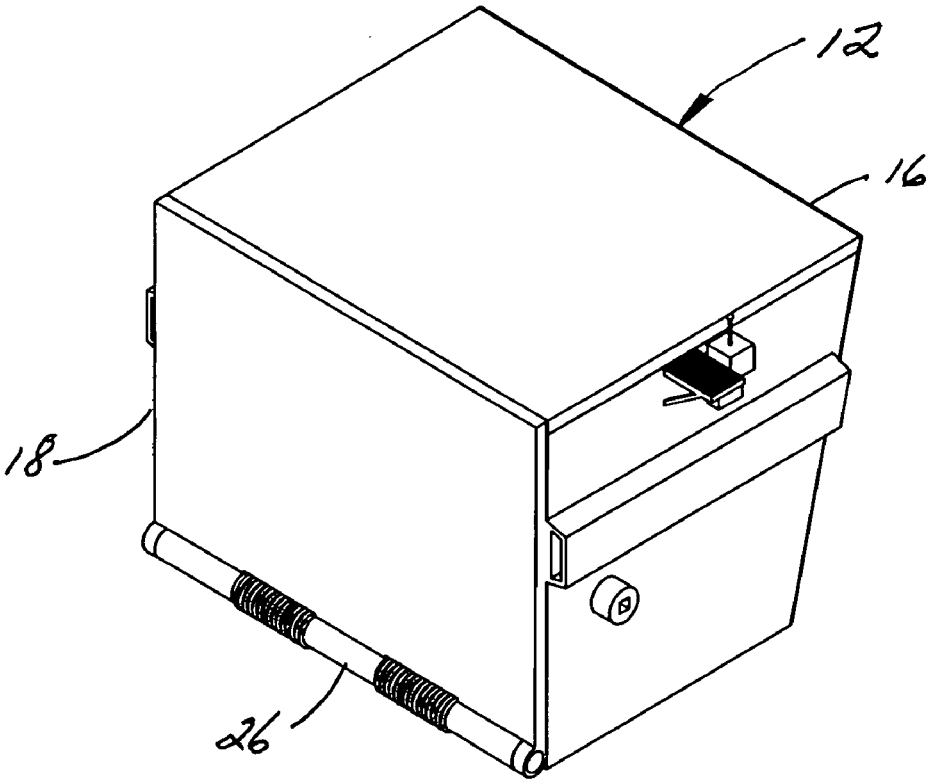
FIG. 15 is a perspective view of the trash receptacle of FIG. 1 in the closed position.
Figure 16:
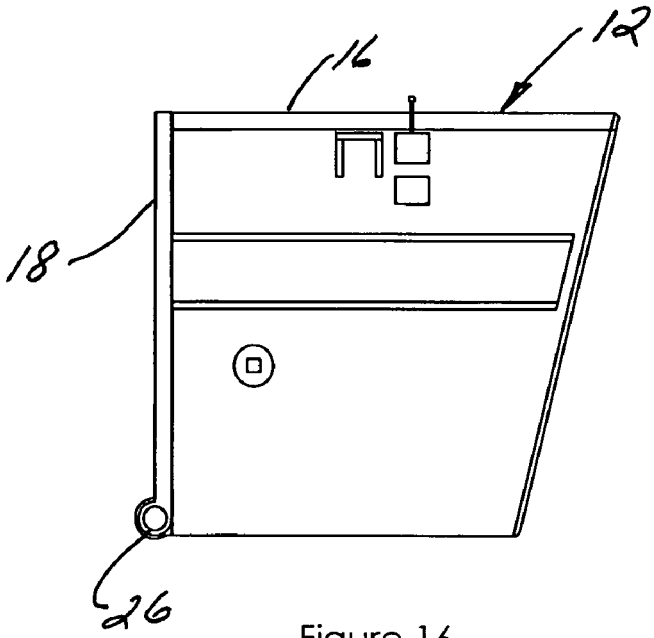
FIG. 16 is a side elevation view of FIG. 15.
Figure 17:
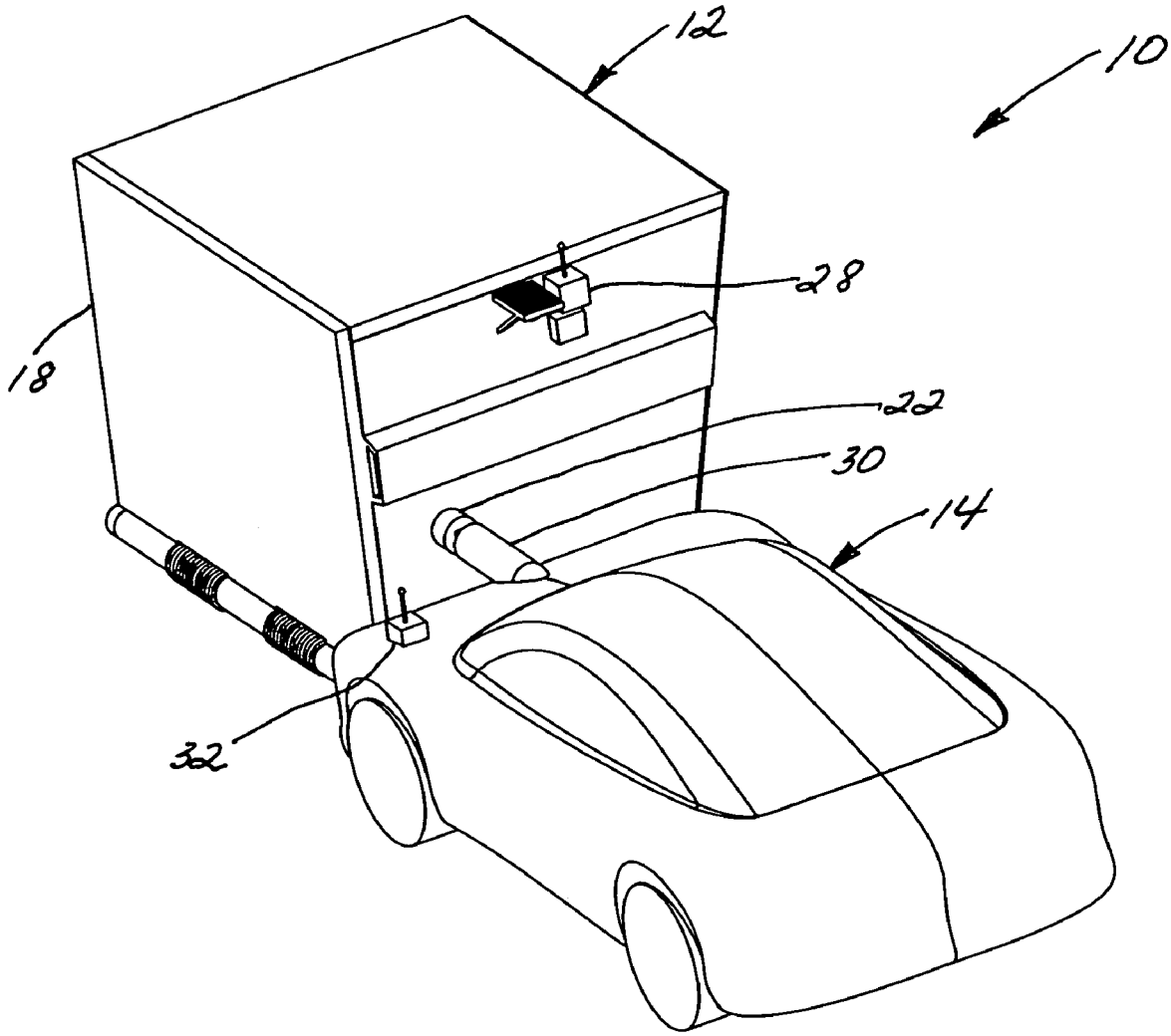
FIG. 17 is a perspective view of the system as shown in FIG. 1 showing the trash receptacle in the closed position.

The trash receptacle 12 also includes a drivable power unit 22 positioned on one side panel of the receptacle 16 and is designed to be rotated in the direction of arrow C and, when so drivingly rotated, to retract a flexible cable 24, one end of which **24*a* is operably connected around the interior end of the power unit 22 as best seen in FIG. 13. The flexible cable 24 extends across the length of the front panel 18 and around pulleys 46 at each end of the front panel 18 and is anchored at 50 onto an interior surface of the opposite side panel of the receptacle 16 as best seen in FIG. 1. By this arrangement, as the power unit 22 when driven in the direction of arrow C, draws the pivotally mounted front panel 18** toward closure in the direction of arrow B.

Figure 7:
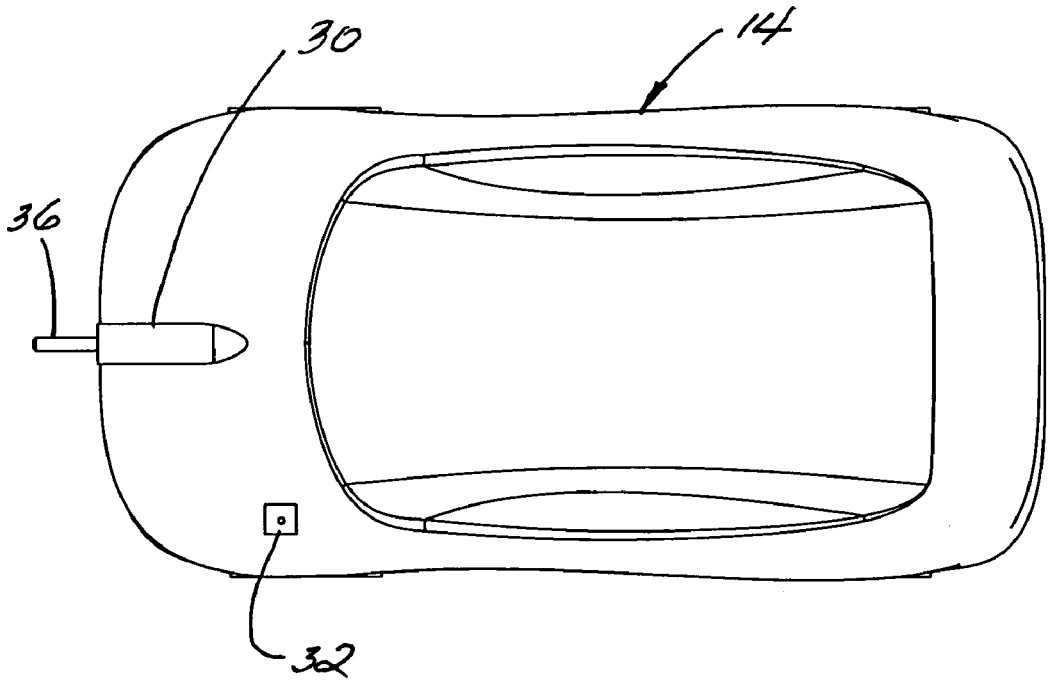
FIG. 7 is a top plan view of the compaction vehicle of FIG. 1.
Figure 8:
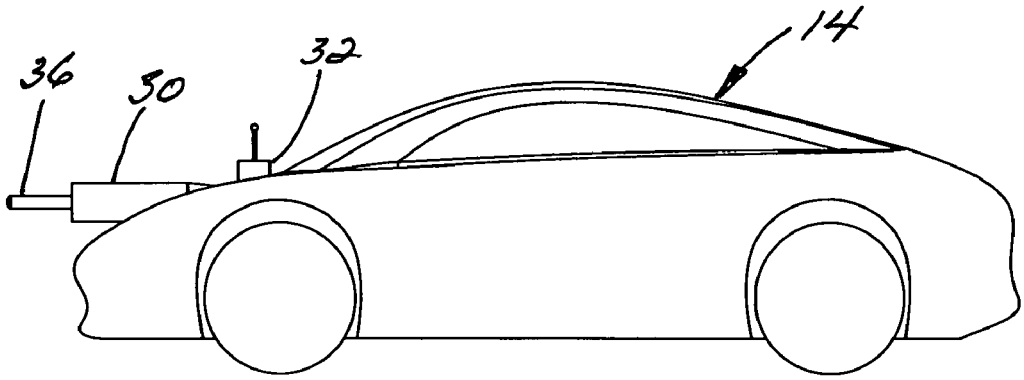
FIG. 8 is a side elevation view of FIG. 7.
Figure 9:
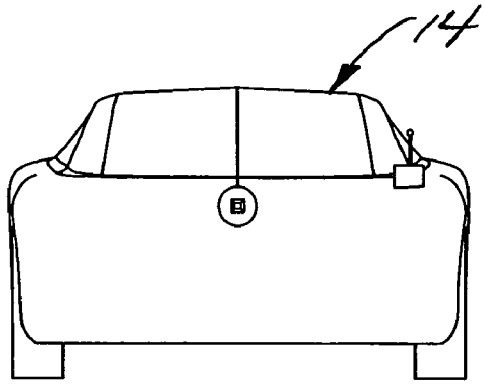
FIG. 9 is a front end elevation view of FIG. 7.
Figure 10:
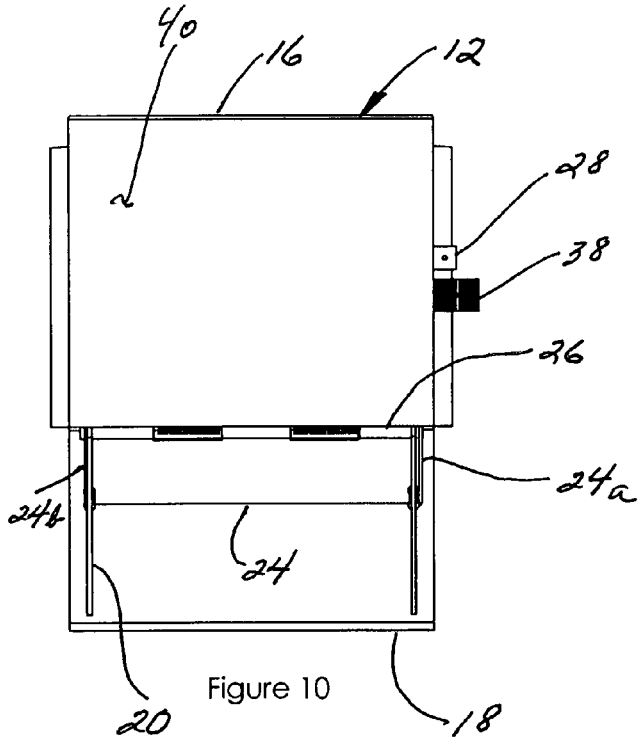
FIG. 10 is a top plan view of the trash receptacle of FIG. 1.
Figure 11:
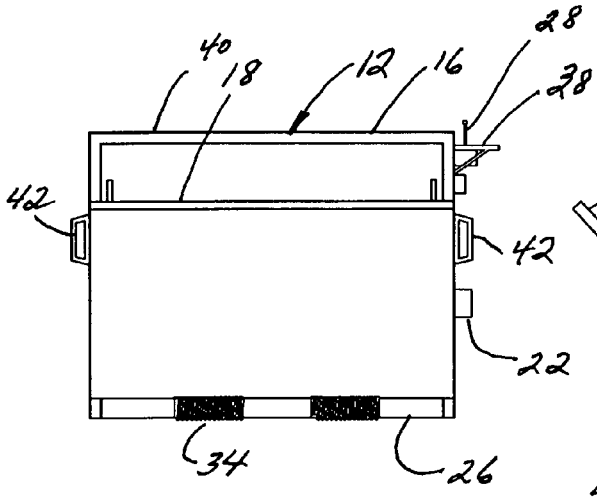
FIG. 11 is a front elevation view of FIG. 10.
Figure 12:
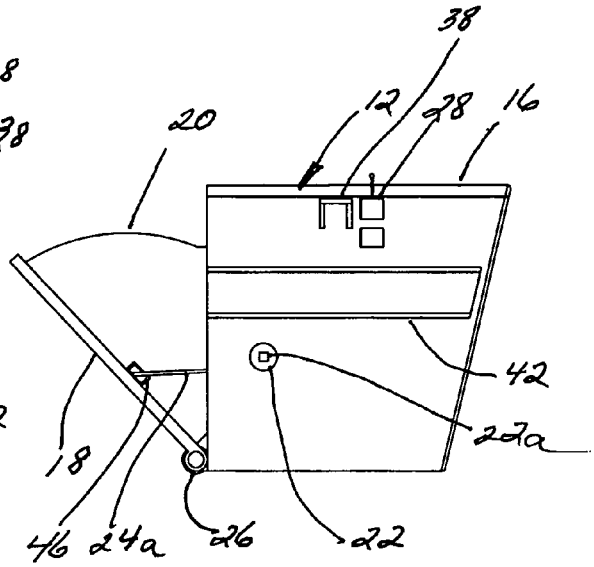
FIG. 12 is a side elevation view of FIG. 10.

The compaction vehicle 14 which, of course, is mobile and easily driven to each trash receptacle 12, slowly approaches the trash receptacle 12 for interengagement of an output shaft 36 (best seen in FIGS. 7 and 8) a power unit 30 strategically mounted on the vehicle 14 to be at a proper height above ground and easily directable for the output shaft 36 into temporary engagement with a mating cavity **22*a* (see FIG. 12) formed into the power unit 22. Thereafter, the power unit output 30 is drivingly rotated in the direction of arrow C to effect closure of the front panel 18** in the direction of arrow B.

When the operator of the compaction vehicle 14 determines that the trash receptacle 12 is completely or substantially completely filled with compressed trash and ready for emptying, a wireless signal will be emitted from transmitter 32 into receiver/transmitter 28 powered by a solar battery panel 38. This transmitter/receiver 28 will then begin emitting a separate wireless signal advising the trash collection company that this particular trash receptacle 12 is ready for emptying. By visually monitoring the content of each of these trash receptacles 12 by the operator of the compaction vehicle 14, premature emptying of only a partially trash filled receptacle 16 is thus avoided at a cost savings to the users of the trash receptacle(s).

Figure 18:
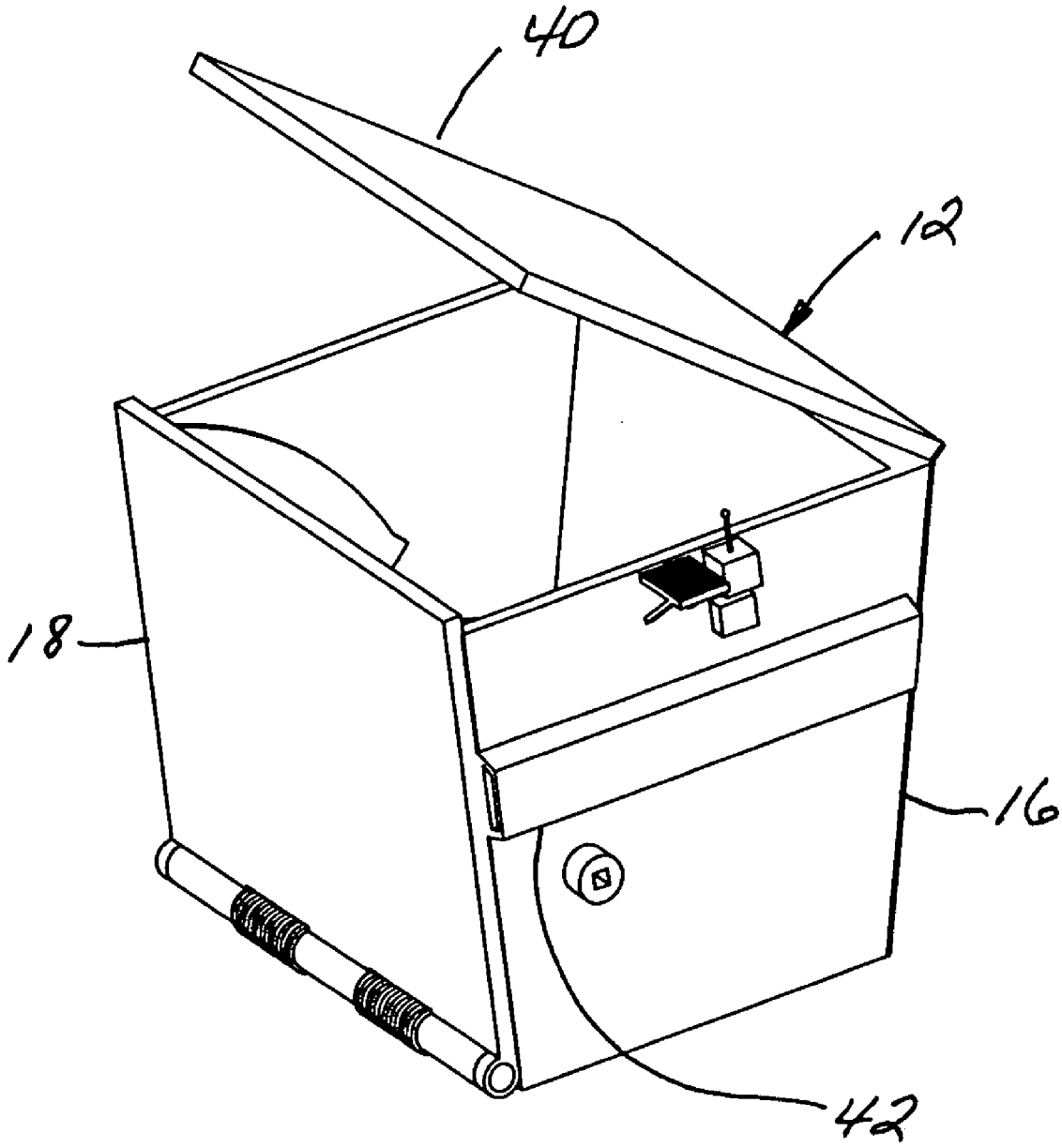
FIG. 18 is a perspective view of the trash receptacle of FIG. 1 showing the lid in an open position.
Figure 19:
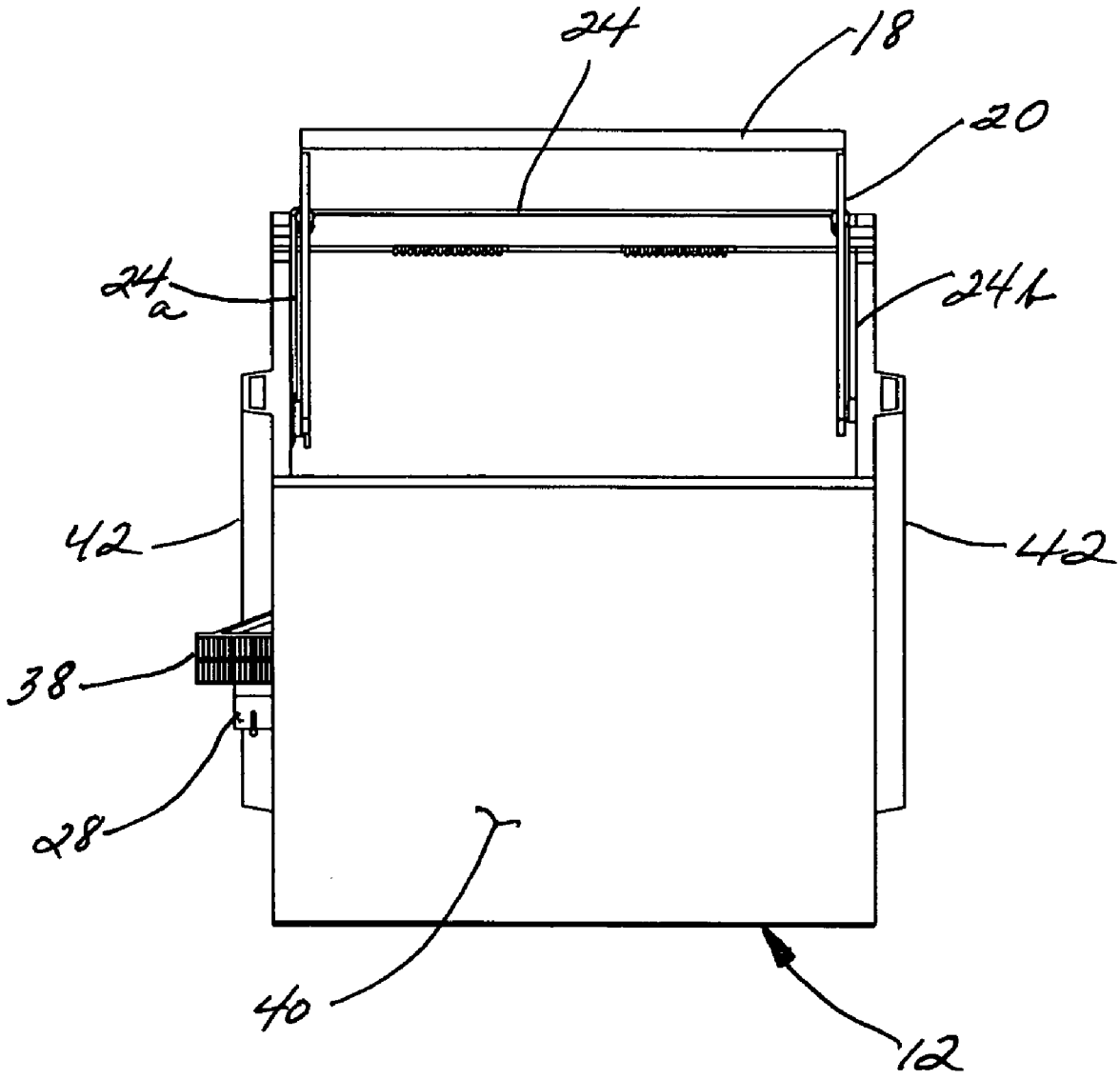
FIG. 19 is a top plan view of FIG. 18.
Figure 20:
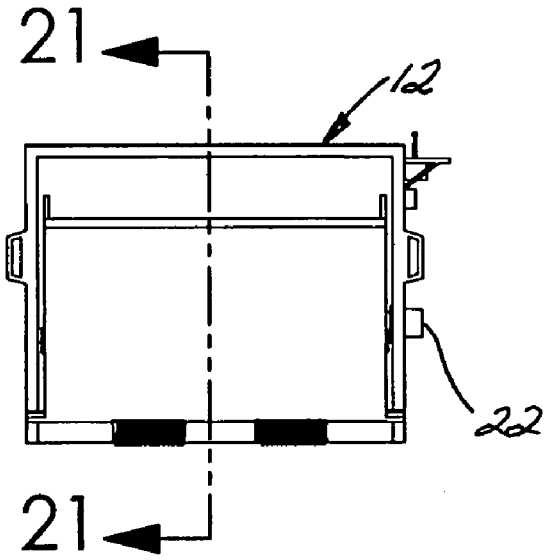
FIG. 20 is a reduced size front elevation view of the trash receptacle of FIG. 1.

When the trash collection facility has been advised that a particular trash receptacle 12 is filled with compacted trash and ready for emptying, a separate trash collection truck (not shown) of well known configuration is sent to the site of the filled trash receptacle 12 whereupon forks extending from the forwardly end of the collection truck interengage with elongated tubular members 42 connected and generally horizontally disposed along the outer surfaces of the side panels of the receptacle 16. As best seen in FIG. 18, the lid 40 being hingedly connected to the upper margin of the back panel of the receptacle 16 will pen by gravity as the trash receptacle 12 is lifted and inverted over the open cargo area of the collection truck. After the compacted trash is thus deposited in the collection truck, the emptied trash receptacle 12 is replaced in position for continuing use. The power unit 22 preferably also insures that the front panel 18 remains closed during this emptying operation.

Figure 23:
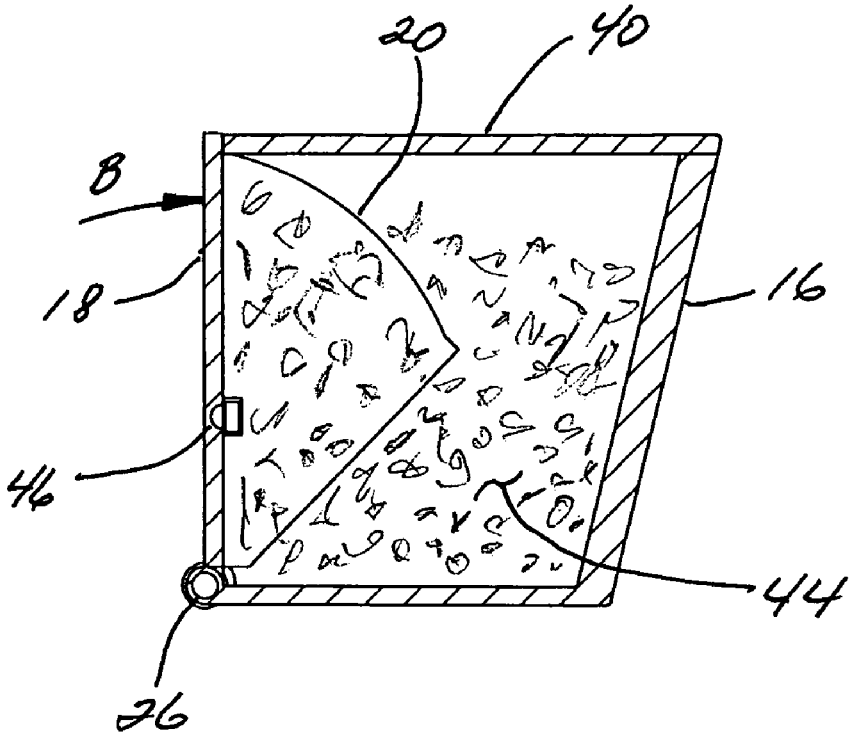
FIG. 23 is a section view in the direction of arrows 23-23 in FIG. 22.
Figure 24:
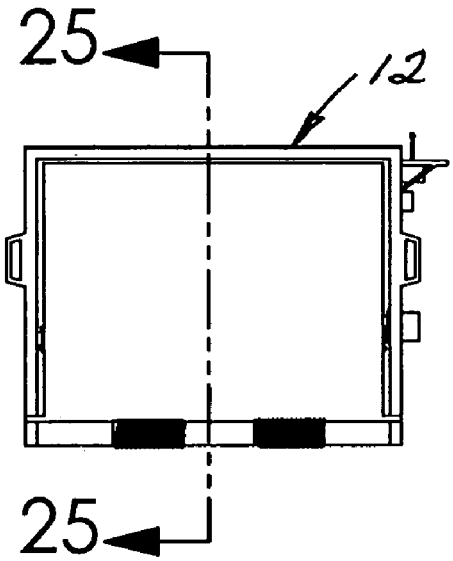
FIG. 24 is a reduced size front elevation view of the trash receptacle showing the front panel in a partially trash compaction position.
Figure 25:
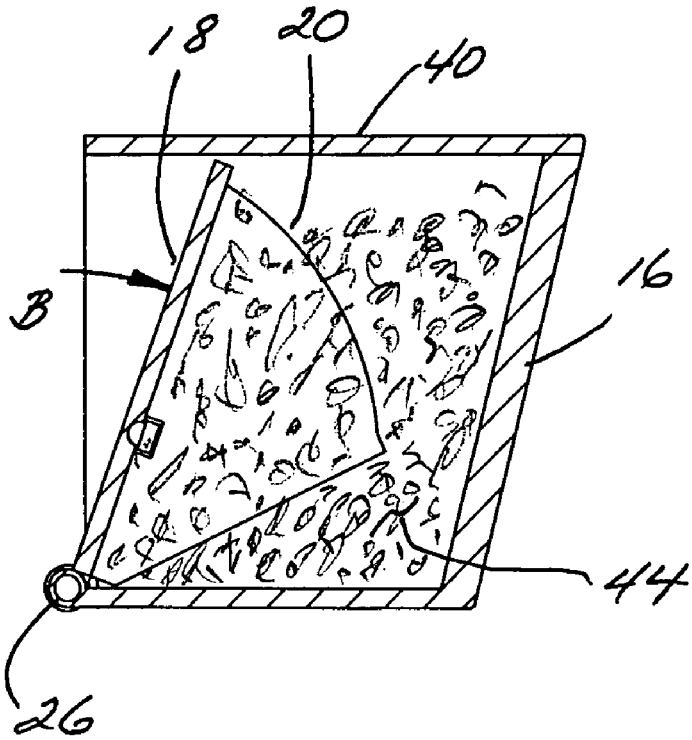
FIG. 25 is a section view in the direction of arrows 25-25 in FIG. 24.

Referring now to FIGS. 20 to 25, the stages of filling the receptacle 16 with trash and the compaction thereof is there shown. In FIG. 21, trash is deposited in the direction of arrow D into the interior volume 44 of the receptacle 16 with the front panel 18 in the open position. When a sufficient amount of trash is accumulated in loose form within the receptacle 16, the compaction vehicle 14 on a preferably scheduled basis visits each separate trash receptacle 12 as previously described to effect compaction of the loose trash within the interior volume 44 of the receptacle 16 at least partially as seen in FIG. 23 wherein the front panel 18 is pivotally moved under power of the compaction vehicle 14 to an upright closed position. However, additional compaction may be preferred as seen in FIG. 25 wherein the front panel 18 moves beyond its normally upright closed position further in the direction of arrow B to effect a more complete compaction of the trash within the interior volume 44. Thereafter, the front panel is caused to be returned to its open position and the compaction vehicle 14 is disengaged from the power unit 22 and continues on its other scheduled trash receptacle visits.

Figure 26:
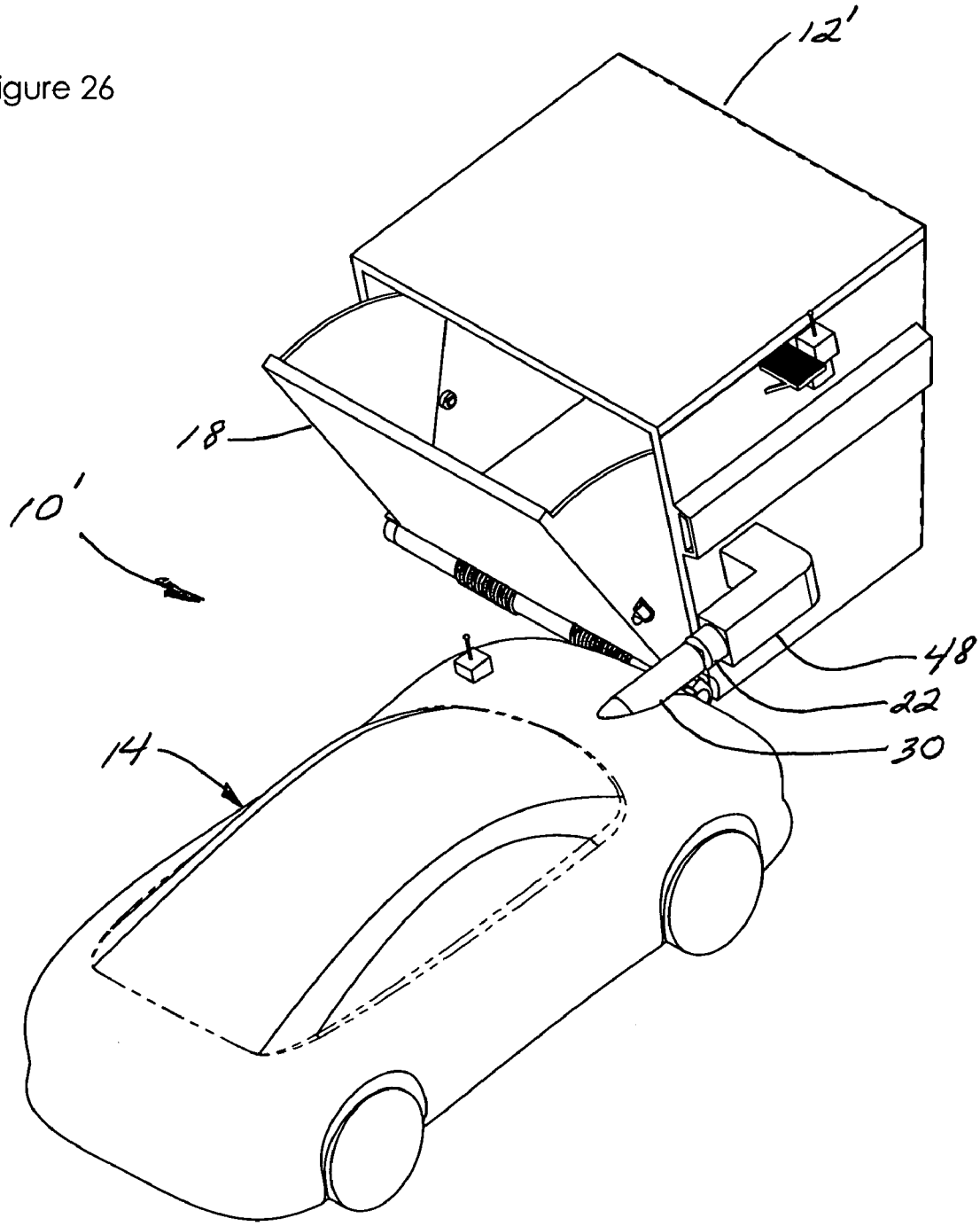
FIG. 26 is a perspective view of an alternate embodiment of the invention.
Figure 27:
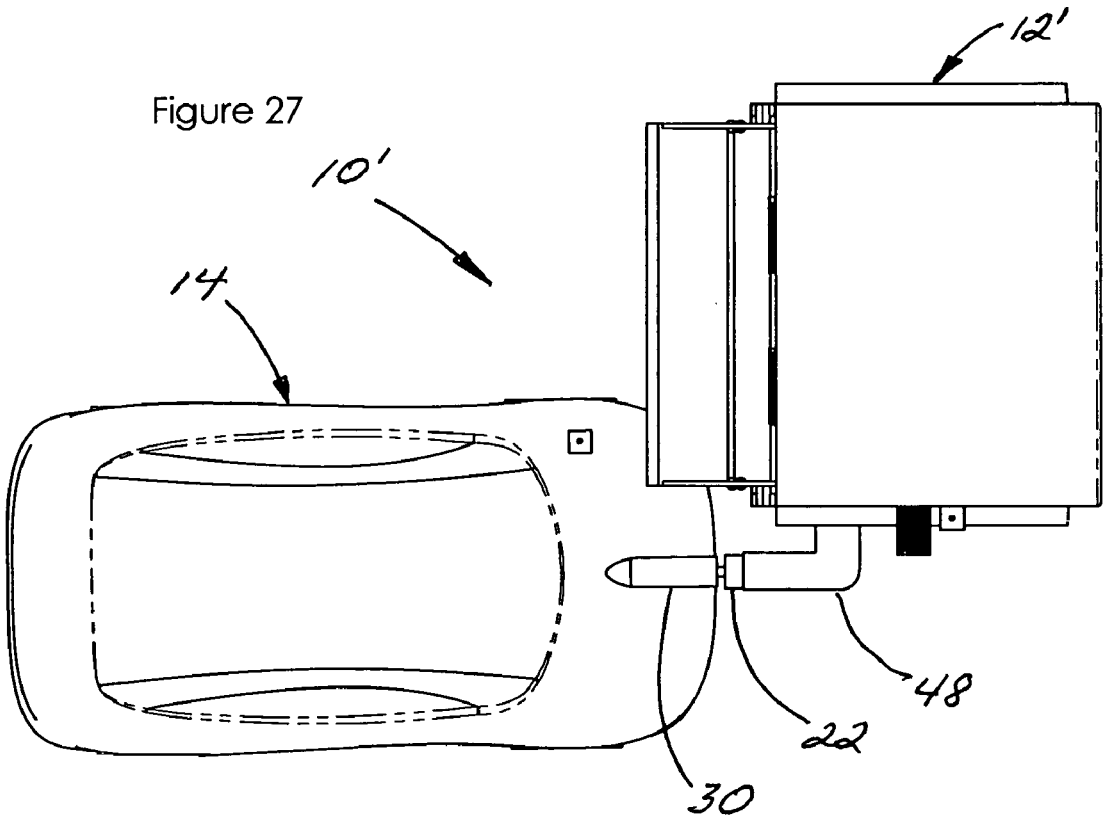
FIG. 27 is a top plan view of FIG. 26.
Figure 28:
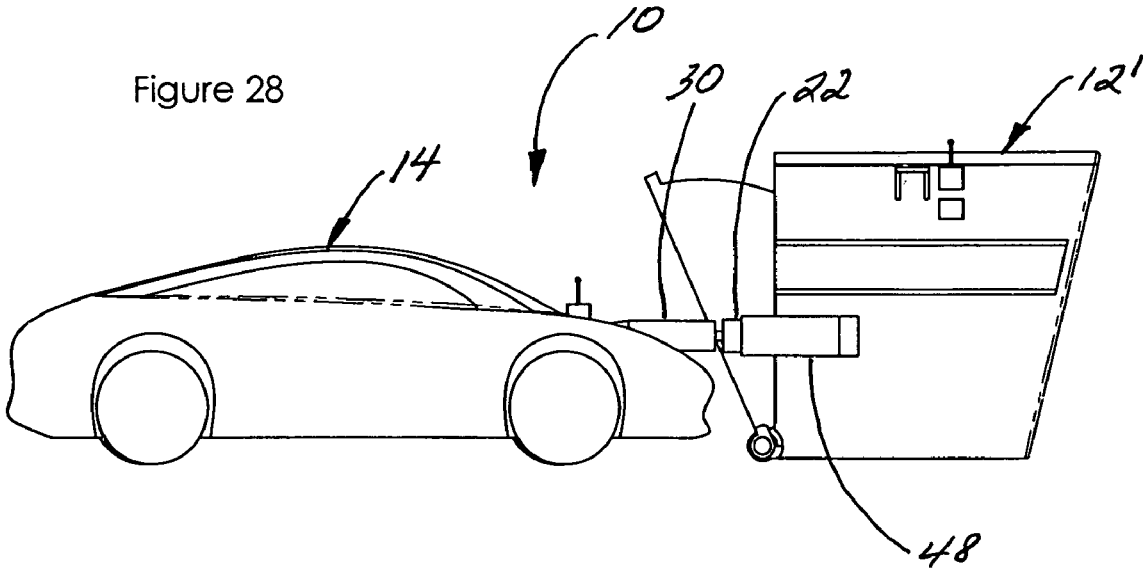
FIG. 28 is a side elevation view of FIG. 26.

Referring now to FIGS. 26 to 28, an alternate and preferred embodiment of the invention is there shown generally at numeral 10' and includes the compaction vehicle 14 wherein a 90° housing 48 supports the power unit 22 in a forwardly facing laterally offset position from the front panel 18. All other features of the trash receptacle 12' are as previously described. By this rearrangement, the compaction vehicle 14 may approach the trash receptacle 12' or trash compaction from a forwardly position similar to that of the trash collection trucks which empty the contents of the trash receptacle 12' as previously described.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A system for compacting trash within a trash receptacle comprising:

said trash receptacle including upstanding front, side and back panels, a closed bottom and a lid, said front panel being pivotably movable and biased outwardly about a pivot axis located along a lower margin thereof to open said trash receptacle;

a drivable power unit positioned on one of said side panels and coupled to a pulling element on said front panel for pivotally moving said front panel between an open position to define a trash deposit opening for placing trash into said receptacle and a closed position to compact trash within said receptacle;

a separate compaction vehicle including a power output which, when said vehicle is driven to said receptacle and said power output is temporarily engaged with said power unit, said front panel is pivotally closed by rotationally driving said power unit with said power output to compact the trash within said receptacle.

2. A system as set forth in claim 1, further comprising:

an end panel connected to and orthogonally extending into an interior volume of said receptacle from each end margin of said front panel for trash containment when said front panel is open.

3. A system as set forth in claim 1, further comprising:

a solar powered wireless transmitter attached to said receptacle which is programmable by a driver of said vehicle to transmit a radio signal advising that said receptacle is full and ready to be emptied.

4. A system as set forth in claim 1, wherein:

said lid automatically opens by gravity when said receptacle is inverted for emptying compacted trash therefrom.

5. A system as set forth in claim 1, wherein:

said front panel is biased to automatically open when said power unit is released.

6. A system for compacting trash within a trash receptacle comprising:

said trash receptacle including upstanding front, side and back panels, a closed bottom, and an openable hinged lid, said front panel being pivotably movable about a lower pivot axis located along a lower margin thereof to open said trash receptacle;

a drivable power unit positioned on said side panel and operably connected to said front panel by an elongated flexible member for pivotally moving said front panel from an open position to define a trash deposit opening for placing trash into said receptacle to a closed position to compact trash within said receptacle, said front panel being biasingly returned to the open position when said power unit is disengaged or deactivated;

a separate compaction vehicle including a power output which, when said vehicle is driven to said receptacle and said power output is temporarily engaged with said power unit, said front panel is pivotally closed by rotationally driving said power unit with said power output to compact the trash within said receptacle.

7. A system as set forth in claim 6, further comprising:

an end panel connected to and orthogonally extending into an interior volume of said receptacle from each end margin of said front panel for trash containment when said front panel is open.

8. A system as set forth in claim 6, further comprising:

a solar powered wireless transmitter attached to said receptacle which is programmable by a driver of said vehicle to transmit a radio signal advising that said receptacle is full and ready to be emptied.

9. A system as set forth in claim 6, wherein:

said lid automatically opens by gravity when said receptacle is inverted for emptying compacted trash therefrom.

10. A system for compacting trash within a trash receptacle comprising:

said trash receptacle including upstanding front, side and back panels, a closed bottom, and a lid, which collectively defines an interior volume, said front panel being pivotably movable about a lower pivot axis located at a lower margin thereof to open said trash receptacle;

a drivable power unit positioned on one of said side panels and coupled to a pulling element on said front panel for pivotally moving said front panel from a closed position to a trash compaction position within said interior volume to compact trash within said receptacle;

a separate compaction vehicle including a power output which, when said vehicle is driven to said receptacle and said power output is temporarily engaged with said power unit, said front panel is pivotally closed by rotationally driving said power unit with said power output to compact the trash within said receptacle.

11. A system as set forth in claim 10, further comprising:

an end panel connected to and orthogonally extending into said interior volume from each end margin of said front panel for trash containment when said front panel is open.

12. A system as set forth in claim 10, further comprising:

a solar powered wireless transmitter attached to said receptacle which is programmable by a driver of said vehicle to transmit a radio signal advising that said receptacle is full and ready to be emptied.

13. A system as set forth in claim 10, wherein:

said lid automatically opens by gravity when said receptacle is inverted for emptying compacted trash therefrom.

14. A system as set forth in claim 10, wherein:

said front panel is biased to automatically open when said power unit is released.

15. A trash receptacle for collecting and compacting trash comprising:

a receptacle including upstanding front, side and back panels, a closed bottom, and an openable hinged lid, said front panel being pivotably movable and biased outwardly about a lower pivot axis located along a lower margin thereof to open said trash receptacle;

a power unit positioned to one of said side panels and operably connected to said front panel by an elongated flexible member for pivotally moving said front panel from an open position to define a trash deposit opening for placing trash into said receptacle to a closed position to compact trash within said receptacle, said power unit being temporarily engagable with a power output of a separate compaction vehicle which is driven to said receptacle to effect operative engagement between the power output and said power unit by rotationally driving said power unit with said power output to close said front panel to compact the trash within said receptacle;

fork lift engaging channels connected to said side panels adapted to receive lifting forks of a trash pickup truck for emptying the contents of said trash receptacle into this truck through the opened said lid;

an end panel connected to and orthogonally extending into an interior volume of said receptacle from each end margin of said front panel for trash containment when said front panel is open.

16. A trash receptacle as set forth in claim 15, further comprising:

a solar powered wireless transmitter attached to said receptacle by a driver of said vehicle to transmit a radio signal advising that said receptacle is full and ready to be emptied.

17. A trash receptacle as set forth in claim 15, wherein:

said lid automatically opens by gravity when said receptacle is inverted for emptying compacted trash therefrom.

18. A trash receptacle as set forth in claim 15, wherein:

said front panel is biased to automatically open when said power unit is released.

* * * * *

UNITED STATES PATENT AND TRADEMARK OFFICE

CERTIFICATE OF CORRECTION

PATENT NO. : 7,434,507 B1
APPLICATION NO. : 11/900338
DATED : October 14, 2008
INVENTOR(S) : Christopher R. Sherwood et al.

It is certified that error appears in the above-identified patent and that said Letters Patent is hereby corrected as shown below:

Col. 8 claim 15, line 8 “to” should be changed to --on--.

Signed and Sealed this

Sixteenth Day of December, 2008

JON W. DUDAS
*Director of the United States Patent and Trademark Office*